US006105557A

United States Patent [19]

Schnaibel et al.

[11] Patent Number: 6,105,557

[45] Date of Patent: Aug. 22, 2000

[54] METHOD OF CHECKING THE OPERABILITY OF A TANK-VENTING SYSTEM

[75] Inventors: Eberhard Schnaibel, Hemmingen; Thorsten Fritz, Gaggenau; Lutz Reuschenbach, Stuttgart, all of Germany

[73] Assignee: Robert Bosch GmbH, Stuttgart, Germany

[21] Appl. No.: 09/358,478

[22] Filed: Jul. 21, 1999

[30] Foreign Application Priority Data

Jul. 30, 1998 [DE] Germany ..... 198 34 332

[51] Int. Cl.[7] ..... F02M 33/02

[52] U.S. Cl. ..... 123/520; 123/198 D

[58] Field of Search ..... 123/520, 521, 123/518, 519, 516, 198 D

[56] References Cited

U.S. PATENT DOCUMENTS 5,273,020 12/1993 Hayami ..... 123/520
5,349,935 9/1994 Mezger ..... 123/520
5,383,438 1/1995 Blumenstock ..... 123/520
5,460,141 10/1995 Denz ..... 123/520
5,483,942 1/1996 Perry ..... 123/520
5,499,614 3/1996 Bosato ..... 123/520
5,553,577 9/1996 Denz ..... 123/520
5,685,279 11/1997 Blomquist ..... 123/520
5,794,599 8/1998 Blumenstock ..... 123/520
5,890,474 4/1999 Schnaibel et al. .

*Primary Examiner*—Carl S. Miller
*Attorney, Agent, or Firm*—Walter Ottesen

[57] ABSTRACT

The invention is directed to a method for checking the operability of a tank-venting system. The tank-venting system includes a tank, an adsorption filter having a tank-venting line, a connecting line for connecting the adsorption filter to the tank, a tank-venting valve and a valve line connecting the adsorption filter to the tank-venting valve. A pressure source is provided for introducing a pressure into the tank-venting system, an operating characteristic variable of the pressure source is detected only over a pregiven time interval ($\Delta t_m$) when introducing the pressure to obtain a time-dependent trace of the operating characteristic variable. The time-dependent trace is extrapolated and a conclusion is drawn as to the presence of a leak therefrom.

5 Claims, 2 Drawing Sheets

I Reference Measurement
II Tank Measurement

METHOD OF CHECKING THE OPERABILITY OF A TANK-VENTING SYSTEM

FIELD OF THE INVENTION

The invention relates to a method of checking the operability of a tank-venting system which includes a tank, an adsorption filter and a tank-venting valve. The adsorption filter is connected to the tank via a tank-connecting line and has a venting line. The tank-venting valve is connected to the adsorption filter via a valve line. A pressure is introduced into the vessel via a pressure source and a conclusion is drawn as to the presence of a leak from the pressure trace and/or the conveyed volume flow. At least one operating variable of the pressure source is detected when introducing the pressure in order to determine the pressure trace and/or the moved volume flow and a conclusion is drawn therefrom as to the presence of a leak.

BACKGROUND OF THE INVENTION

A method of the above kind is disclosed, for example, in U.S. Pat. No. 5,890,474 and in U.S. patent application Ser. No. 09/263,787, filed Mar. 5, 1999.

The check of the operability which takes place only when the vehicle is at standstill requires a checking time, measuring time or diagnostic time of 5 minutes or more for a vehicle having a very large tank volume such as a tank volume of from 80 to 100 liters. A check or diagnostic time which is so long is unwanted because it cannot be ensured during this time that the check operation is in any way disadvantageously affected. Checking as to the operability takes place when the vehicle is at standstill. If, for example, a check is started during a short stop of the vehicle such as at a traffic light of the like, then, in most cases, the time in which the vehicle is stopped is not sufficient in order to undertake a complete check of the operability of the tank-venting system.

SUMMARY OF THE INVENTION

It is an object of the invention to provide a method for checking the operability of a tank-venting system which is so improved that the checking or diagnostic time is significantly shortened.

The method of the invention is for checking the operability of a tank-venting system. The tank-venting system includes a tank, an adsorption filter having a tank-venting line, a connecting line for connecting the adsorption filter to the tank, a tank-venting valve and a valve line connecting the adsorption filter to the tank-venting valve. The method includes the steps of: providing a pressure source for introducing a pressure into the tank-venting system; detecting an operating characteristic variable of the pressure source only over a pregiven time interval ($\Delta t_m$) when introducing the pressure to obtain a time-dependent trace of the operating characteristic variable; and, extrapolating the time-dependent trace and drawing a conclusion as to the presence of a leak therefrom.

A significant shortening of the checking or diagnostic time is achieved with the detection of at least one operating variable in the pregiven time interval and by extrapolation of the detected time-dependent trace of this operating variable and the conclusion as to the presence of a leak based on the extrapolated data. Nonetheless, a reliable check of the operability of the tank-venting system is possible by the extrapolation.

Preferably, the time interval is approximately 30 to 60 seconds. It has been shown that an adequate quantity of data can be detected for a reliable extrapolation within such a time interval.

In principle, it would be possible to initially detect one or several operating variables of the pressure source based on a comparison leak and to store the same in a memory and, in later measurements, to compare the detected operating variables with these operating variables stored in the memory and so draw a conclusion as to the presence of a leak. In this way, a relatively precise conclusion can be drawn as to the presence of a leak, however, it is not possible, to consider with such a method, for example, the effects of deterioration of the tank-venting system or of the motor vehicle or to consider additional variables influencing the measurement such as temperature, air pressure of the atmosphere and the like.

For the above reasons, an especially advantageous embodiment provides that different operating states of the vehicle are considered (including operating states which are caused by deterioration) wherein the tank-venting system and a reference leak are charged alternately. The operating variables of the pressure source when introducing the pressure into the tank-venting system and when introducing the pressure into the reference leak are detected and compared to each other and a conclusion as to a leak is drawn therefrom.

Providing a reference leak affords the substantial advantage that, on the one hand, representative comparison operating characteristic variables must not be stored in a memory for a leak which is present and the memory can therefore be omitted and, on the other hand, that all operating states of the vehicle are also considered such as temperature, deterioration and the like.

With respect to the reference leak, the most different embodiments thereof can be considered.

An especially advantageous embodiment provides that the reference leak is arranged in parallel to the tank-venting system. This embodiment makes possible especially a "proper" reference measurement in the sense presented above.

Another advantageous embodiment provides that the reference leak is simulated by a controlled partial opening of the tank-venting valve. In this way, an additional reference leak branch in the tank-venting system can be omitted. By driving the tank-venting valve so that it is partially open, any desired leak size can be realized in an especially advantageous manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 2:
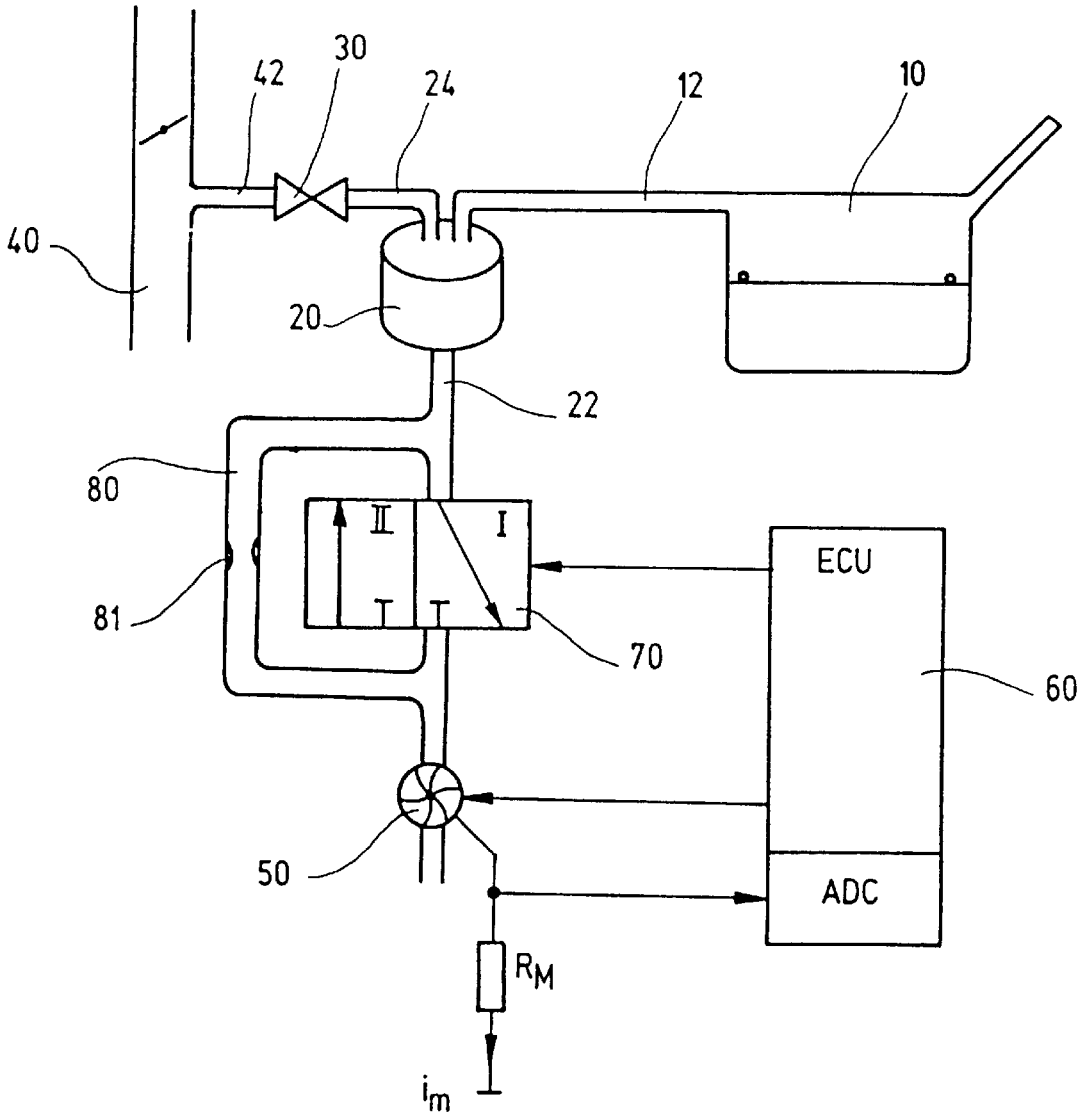

A tank-venting system of a vehicle tank system is shown in FIG. 2 and includes a tank 10, an adsorption filter 20 and a tank-venting valve 30. The adsorption filter 20 is, for example, an active charcoal filter which is connected to the tank 10 via a tank-connecting line 12. The adsorption filter 20 includes a venting line 22 which can be connected to the ambient. The tank-venting valve 20 is, on the one hand, connected to the adsorption filter 20 via a valve line 24 and, on the other hand, to an intake manifold 40 of an internal combustion engine (not shown) via a valve line 42.

Hydrocarbons develop in the tank 10 because of vaporization and deposit in the adsorption filter 20. The tank-venting valve 30 is opened to regenerate the adsorption filter 20 so that air of the atmosphere is drawn by suction through the adsorption filter 20 because of the underpressure present in the intake manifold 40. In this way, the hydrocarbons deposited in the adsorption filter 20 are inducted into the intake manifold 40 and supplied to the engine.

A pump 50 is provided in order to be able to diagnose the operability of the tank-venting system. The pump 50 is connected to a circuit unit 60. A switchover valve 70 is connected downstream of the pump and is, for example, in the form of a 3/2 directional valve. A reference leak 81 is arranged parallel to this switchover valve 70 in a parallel branch 80. The size of the reference leak 81 is so selected that it corresponds to the size of the leak to be detected (between 0.3 mm and 0.8 mm).

It is understood that the reference leak 81 can, for example, also be a part of the switchover valve 70 defined, say, by a channel constriction or the like so that, in this case, an additional reference part can be omitted (not shown).

The check of the operability of the tank-venting valve can be made, for example, as disclosed in U.S. Pat. No. 5,890,474 and in U.S. patent application Ser. No. 09/263,787, filed Mar. 5, 1999, and incorporated herein by reference. By detecting the motor current $i_{mot}$, which is supplied to the pump motor, a determination is made as to whether the pump flow, which is to be supplied by the pressure source 50 into the tank-venting system, deviates from the pump flow which is present when introducing the overpressure via the reference leak 81. If this is the case, a fault is present.

Figure 1:
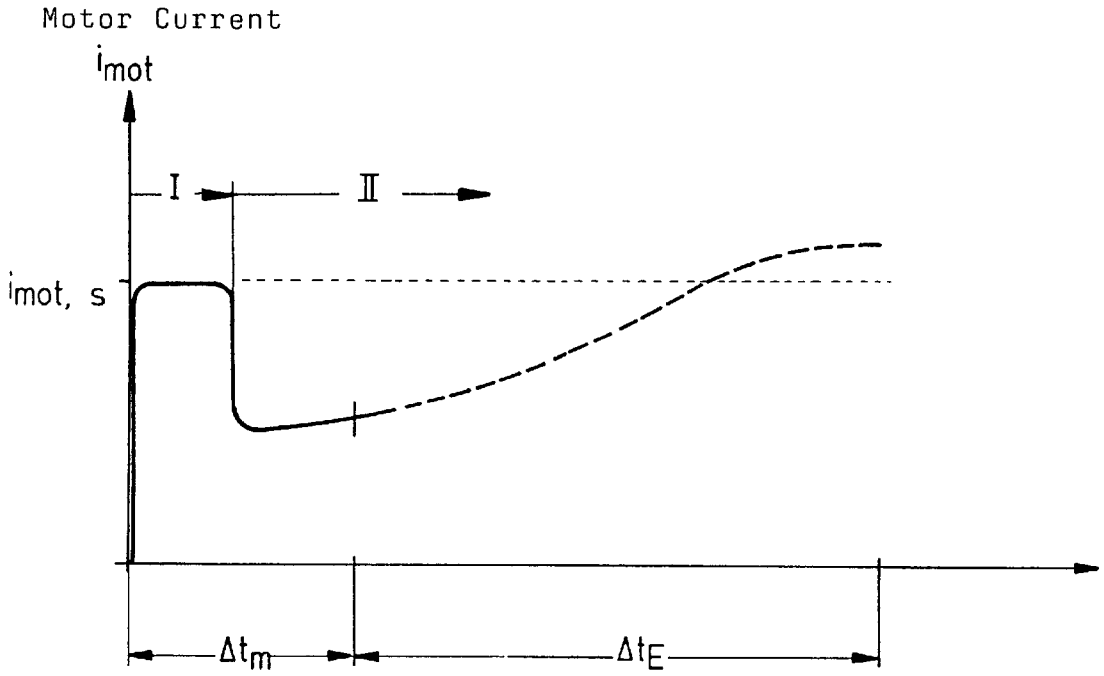
FIG. 1 is a graph showing the characteristic time-dependent trace of the motor current of an overpressure pump used for checking a tank-venting system; and, FIG. 2 is a schematic of a tank-venting system wherein the method of the invention is applied.

In FIG. 1, the time-dependent trace of the current $i_{mot}$, which results when voltage is applied to the pressure source 50 (that is, applied to the overpressure source), is schematically presented.

The trace shown in FIG. 1 corresponds to the time-dependent trace of the motor current $i_{mot}$ of an operable tank-venting system. In the time segment identified by I, the switchover valve 70 is in the position identified by I as shown in FIG. 2. In this position of the switchover valve 70, a pump flow is introduced into the tank-venting system through the reference leak 81 by the pressure source 50. A current $i_{mot}$ which is essentially constant in time adjusts as shown schematically in FIG. 1. As soon as the switchover valve 70 is switched over from the position I to the position II, the pressure source 50 charges the tank-venting system with an overpressure. With a switchover, the motor current $i_{mot}$ drops rapidly and thereafter increases with time continuously (approximately the trace of an exponential function) until it reaches a value which, for a tight tank, lies above the motor current $i_{mot}$ which results in position I of the switchover valve 70. This time-dependent trace shown in FIG. 1 is characteristic for an operable tank-venting system.

The overpressure is introduced into the tank-venting system in a position II of the switchover valve 70.

For large tank volumes of approximately 80 to 100 liters, a check of this kind of the operability of the tank-venting system requires a measuring time of approximately 5 minutes.

To considerably reduce the measuring time, a measurement is made in the time interval identified in FIG. 1 with $\Delta t_m$. The measurement values which are detected in the switch position II of the switchover valve 70 are used as the basis for an extrapolation of the time-dependent trace of the motor current $i_{mot}$ for a time interval $\Delta t_E$. The extrapolated trace is shown in FIG. 1 by the broken line. The trace of the curve in the switch position II of the switchover valve 70 corresponds substantially to an exponential function so that an extrapolation with adequate accuracy is easily possible. A check is then made in switching unit 60 as to whether the extrapolated values in the extrapolation time interval $\Delta t_E$ exceed the threshold value of the motor current $i_{mot,s}$ detected in switch position I of the switchover valve 70. If this is the case, then a conclusion is drawn as to an operable tank-venting system. If this is not the case, a leak must be assumed.

It is understood that the foregoing description is that of the preferred embodiments of the invention and that various changes and modifications may be made thereto without departing from the spirit and scope of the invention as defined in the appended claims.

What is claimed is:

1. A method for checking the operability of a tank-venting system, the tank-venting system including a tank, an adsorption filter having a tank-venting line, a connecting line for connecting the adsorption filter to the tank, a tank-venting valve and a valve line connecting the adsorption filter to the tank-venting valve, the method comprising the steps of:

providing a pressure source for introducing a pressure into said tank-venting system;

connecting reference leak means in parallel to said tank-venting system;

detecting an operating characteristic variable of said pressure source only over a pregiven time interval ($\Delta t_m$) when introducing said pressure to obtain a time-dependent trace of said operating characteristic variable; and, alternately applying pressure to said reference leak means and detecting said operating characteristic variable while introducing said pressure into said reference leak means to obtain a first time-dependent trace of said operating characteristic variable and to said tank-venting system and detecting said operating characteristic variable while introducing pressure into said tank-venting system to obtain a second time-dependent trace of said operating characteristic variable; and, extrapolating and comparing said first and second time-dependent traces to each other and drawing a conclusion as to the presence of a leak in said tank-venting system from the comparison.

2. The method of claim 1, wherein said time interval ($\Delta t_m$) is between 30 and 60 seconds.

3. The method of claim 1, comprising the further step of providing a switching device for connecting said reference leak in parallel with said tank-venting system.

4. The method of claim 1, comprising the further step of simulating said reference leak means by a controlled partial opening of said tank-venting valve.

5. A method for checking the operability of a tank-venting system, the tank-venting system including a tank, an adsorption filter having a tank-venting line, a connecting line for connecting the adsorption filter to the tank, a tank-venting valve and a valve line connecting the adsorption filter to the tank-venting valve, the method comprising the steps of:

providing a pump having an electric motor for introducing a pressure into said tank-venting system;

selecting an operating characteristic variable of said electric motor from at least one of the following: the electric current (imot) drawn by said electric motor; the voltage applied to said electric motor; and, the rpm of said electric motor;

detecting said operating characteristic variable of said electric motor only over a pregiven time interval ($\Delta t_m$) when introducing said pressure to obtain a time-dependent trace of said operating characteristic variable; and, extrapolating said time-dependent trace and drawing a conclusion as to the presence of a leak therefrom.

* * * * *